US009630191B2

(12) United States Patent
Kuo

(10) Patent No.: US 9,630,191 B2
(45) Date of Patent: Apr. 25, 2017

(54) SPRAY STRUCTURE OF WATER SPRAY GUN

(71) Applicant: ZHANGZHOU LEYUAN INDUSTRIAL CO., LTD., ZhangZhou (CN)

(72) Inventor: Wen Li Kuo, ZhangZhou (CN)

(73) Assignee: ZHANGZHOU LEYUAN INDUSTRIAL CO., LTD., Zhangzhou, Fujian (CN)

( * ) Notice: Subject to any disclaimer, the term of this patent is extended or adjusted under 35 U.S.C. 154(b) by 82 days.

(21) Appl. No.: 14/548,309

(22) Filed: Nov. 20, 2014

(65) Prior Publication Data

US 2015/0375240 A1 Dec. 31, 2015

(30) Foreign Application Priority Data

Jun. 25, 2014 (CN) ..... 2014 2 0341455 U

(51) Int. Cl.

| | |
|---|---|
| ***B05B 1/34*** | (2006.01) |
| ***B05B 1/14*** | (2006.01) |
| *B05B 9/01* | (2006.01) |
| *B05B 1/16* | (2006.01) |

(52) U.S. Cl.

CPC ..... *B05B 1/14* (2013.01); *B05B 1/3426* (2013.01); *B05B 1/169* (2013.01); *B05B 9/01* (2013.01)

(58) Field of Classification Search

CPC B05B 1/14; B05B 1/16; B05B 1/1627; B05B 1/1636; B05B 1/1645; B05B 1/1654; B05B 1/3426; B05B 1/169; B05B 1/18; B05B 1/185; B05B 9/01

USPC ..... 239/548, 468, 392, 394

See application file for complete search history.

(56) References Cited

U.S. PATENT DOCUMENTS

| | | | | |
|---|---|---|---|---|
| 6,622,945 | B1 * | 9/2003 | Wu | B05B 1/1654 239/443 |
| 2006/0237560 | A1 * | 10/2006 | Chih | B05B 1/1654 239/394 |
| 2011/0031333 | A1 * | 2/2011 | Short | F23D 11/383 239/548 |
| 2013/0015272 | A1 * | 1/2013 | Raab | B05B 1/1618 239/548 |
| 2013/0292494 | A1 * | 11/2013 | Chen | B05B 1/1636 239/442 |

* cited by examiner

*Primary Examiner* — Arthur O Hall
*Assistant Examiner* — Juan C Barrera
(74) *Attorney, Agent, or Firm* — Leong C. Lei

(57) ABSTRACT

A spray structure of a water spray gun is formed on a surface cover of the water spray gun. The surface cover is formed with a plurality of spray orifices. The inner side of the surface cover is formed with annular flanges each corresponding to the edge of each spray orifice. Each flange is formed with a tangential opening. The surface cover of the present invention is formed with the tangential opening instead of the inclined opening of the water distribution member of the prior art. When the water flows to the tangential opening and then enters the flange to be rotated and sprayed out through the spray orifices. The tangential opening of the present invention is flat and smooth and won't be blocked. The water spray gun won't be damaged easily and has a long service life. The cost is reduced.

2 Claims, 6 Drawing Sheets

SPRAY STRUCTURE OF WATER SPRAY GUN

BACKGROUND OF THE INVENTION

1. Field of the Invention

The present invention relates to a water spray gun, and more particularly to a spray structure of a water spray gun.

2. Description of the Prior Art

As shown in FIG. 1 to FIG. 3, a conventional water spray gun for gardening is provided with a water distribution member 20 installed in the gun body (not shown in the drawings). The water distribution member 20 is formed with a plurality of water distribution holes 201. A surface cover 10 is installed on the gun body. The surface cover 10 is formed with a plurality of spray orifices 101. When in use, water flows from the water inlet of the gun body to the gun body, and then flows to the water outlets of the gun body. The water flows to the spray orifices 101 of the surface cover 10 through the water distribution holes 201 of the water distribution member 20. Finally, the water sprays out from each spray orifice 101.

The water distribution holes 201 of the water distribution member 20 of the conventional water spray gun are specially designed to spray water in the form of fog. Preferably, one of the water distribution holes 202 is formed with two opposing inclined openings 202. The water flows to the inclined openings 202 to be rotated, and then sprays out through the spray orifices 101 in the form of fog. However, the inclined openings 202 are small and the edges are angular. In general, the water used for gardening is bad. The inclined openings 202 are blocked easily. The water spray gun may be damaged easily to cause a high cost of use.

Accordingly, the inventor of the present invention has devoted himself based on his many years of practical experiences to solve these problems.

SUMMARY OF THE INVENTION

The primary object of the present invention is to provide a spray structure of a water spray gun, preventing blocking and reducing the cost.

In order to achieve the aforesaid object, the spray structure is formed on a surface cover of the water spray gun. The surface cover is formed with a plurality of spray orifices. The inner side of the surface cover is formed with annular flanges each corresponding to the edge of each spray orifice. Each flange is formed with a tangential opening.

Preferably, each flange is formed with two symmetrical tangential openings tangent to an inner wall thereof.

The surface cover of the present invention is formed with the tangential opening instead of the inclined opening of the water distribution member of the prior art. When the water flows to the tangential opening and then enters the flange to be rotated and sprayed out through the spray orifices. The tangential opening of the present invention is flat and smooth and won't be blocked. The water spray gun won't be damaged easily and has a long service life, and the cost is reduced.

DETAILED DESCRIPTION OF THE PREFERRED EMBODIMENTS

Embodiments of the present invention will now be described, by way of example only, with reference to the accompanying drawings.

Figure 1:
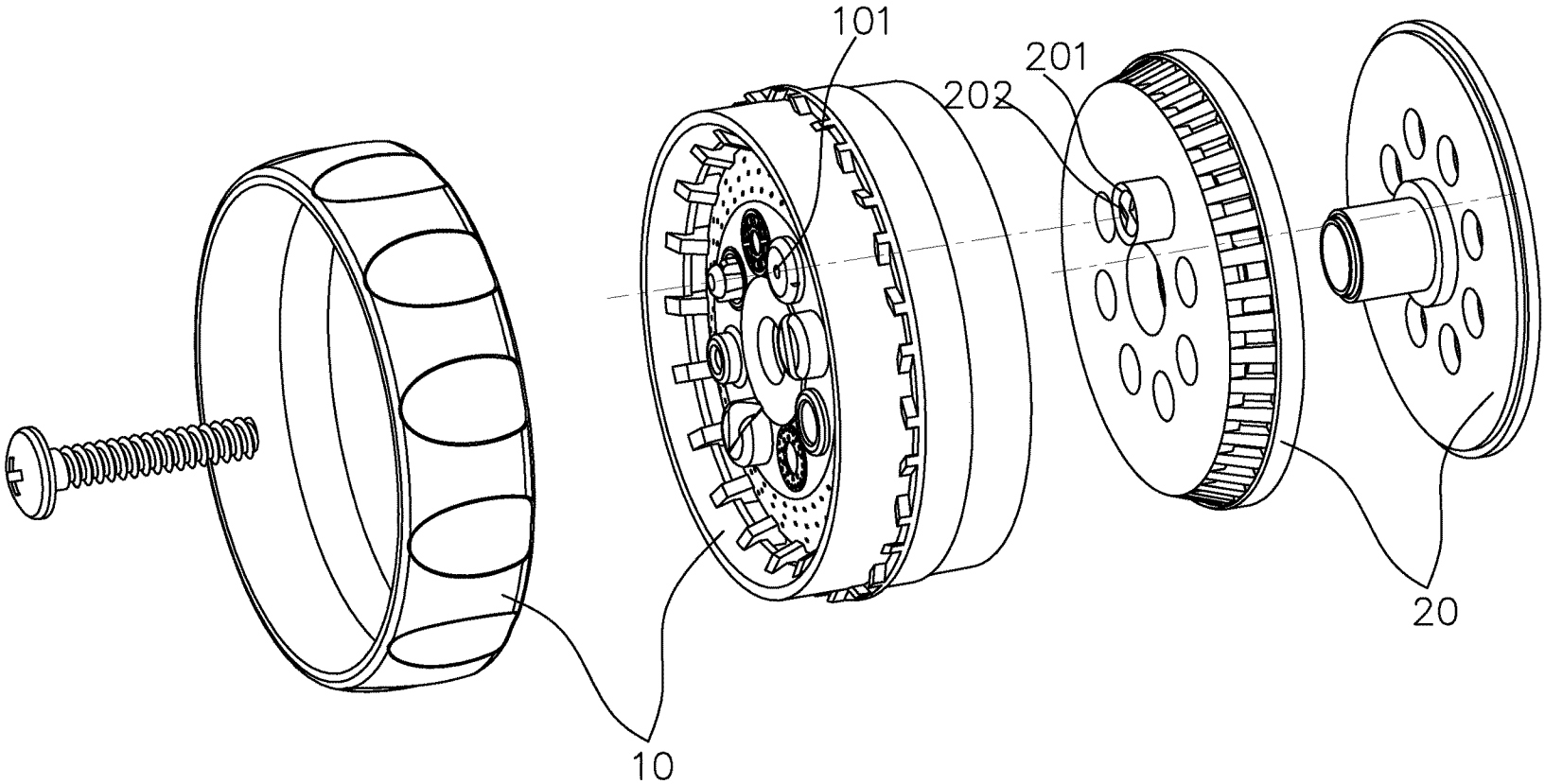
FIG. 1 is an exploded view of a water distribution member and a surface cover of a conventional water spray gun.
Figure 2:
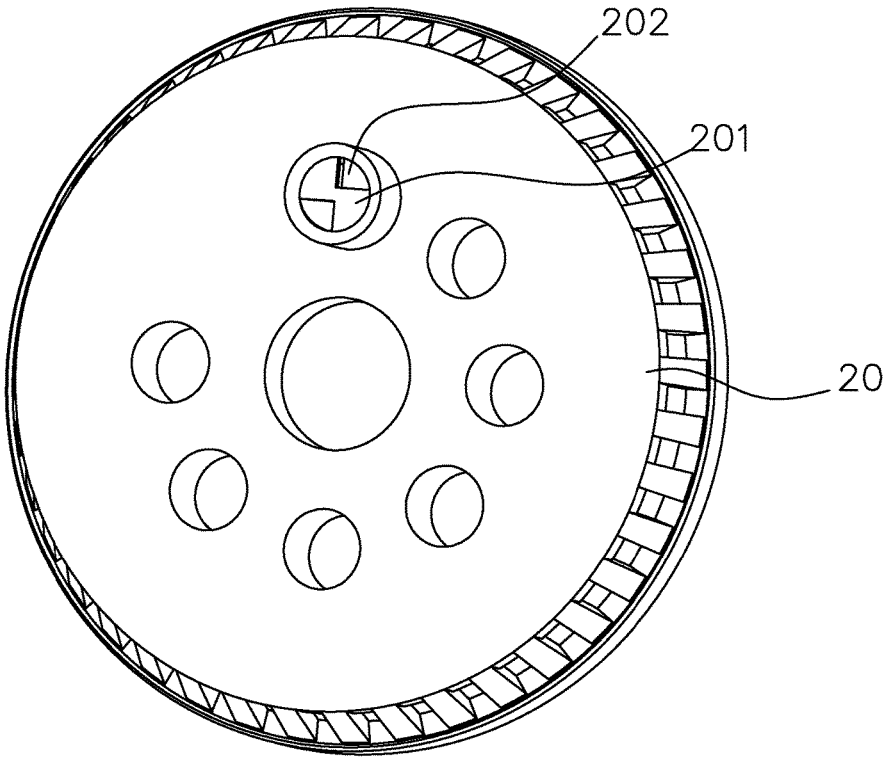
FIG. 2 is a perspective view of the water distribution member of the conventional water spray gun.
Figure 3:
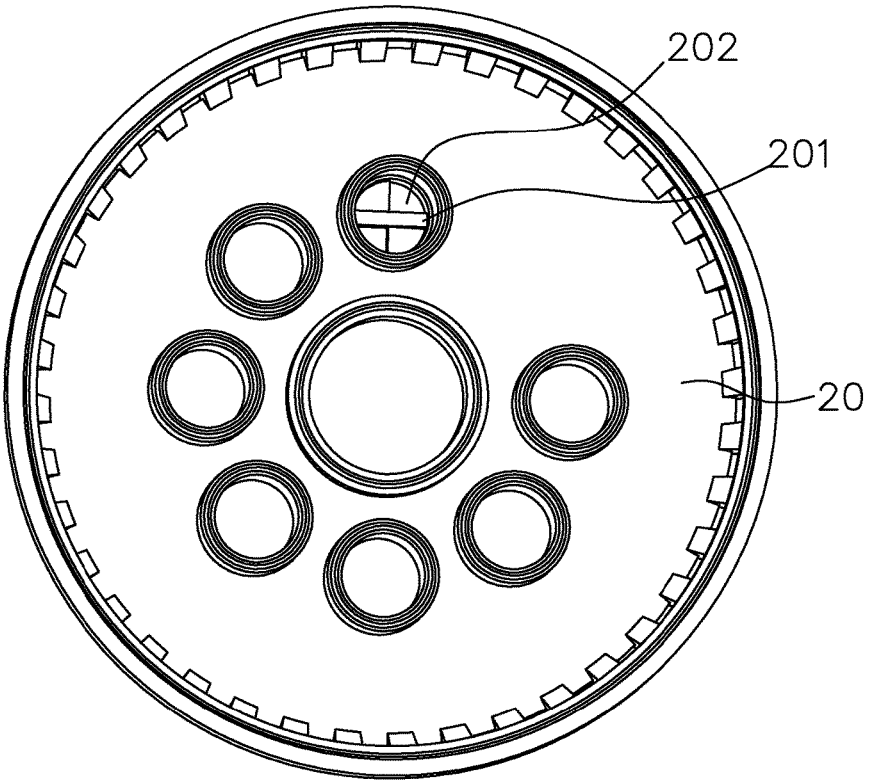
FIG. 3 is a bottom view of the water distribution member of the conventional water spray gun.
Figure 4:
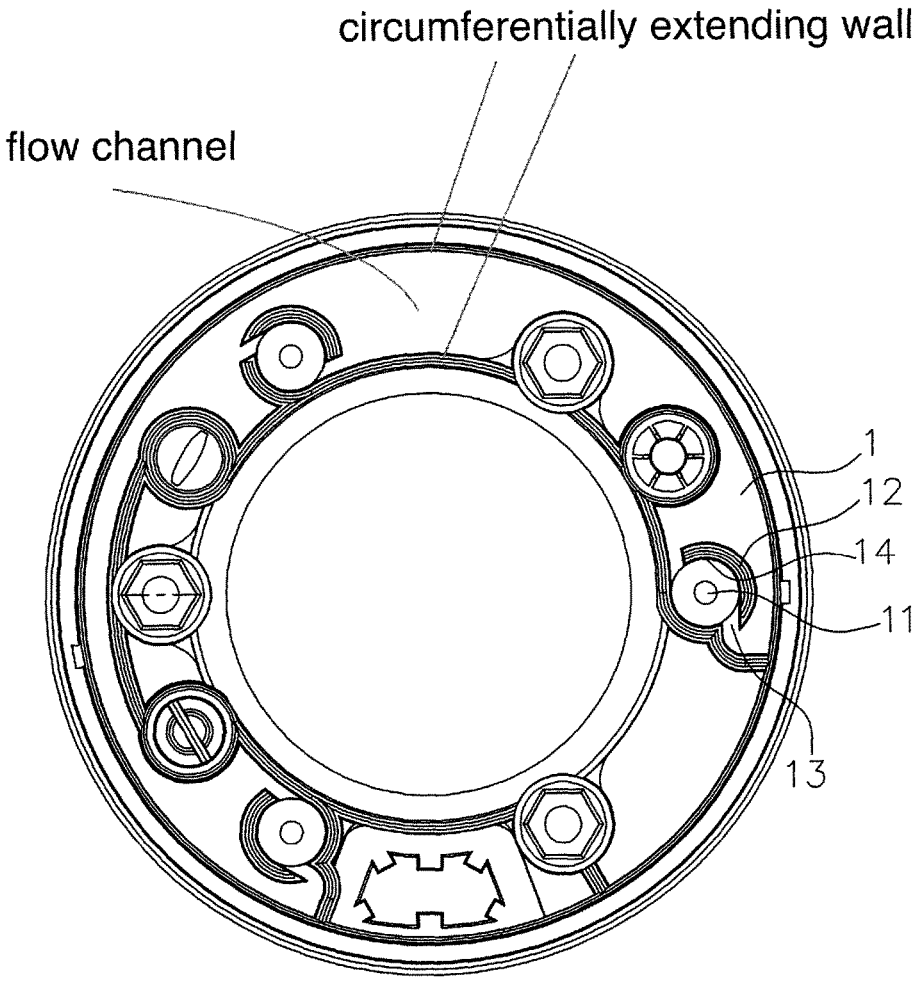
FIG. 4 is a top view of a surface cover according to a preferred embodiment of the present invention.
Figure 5:
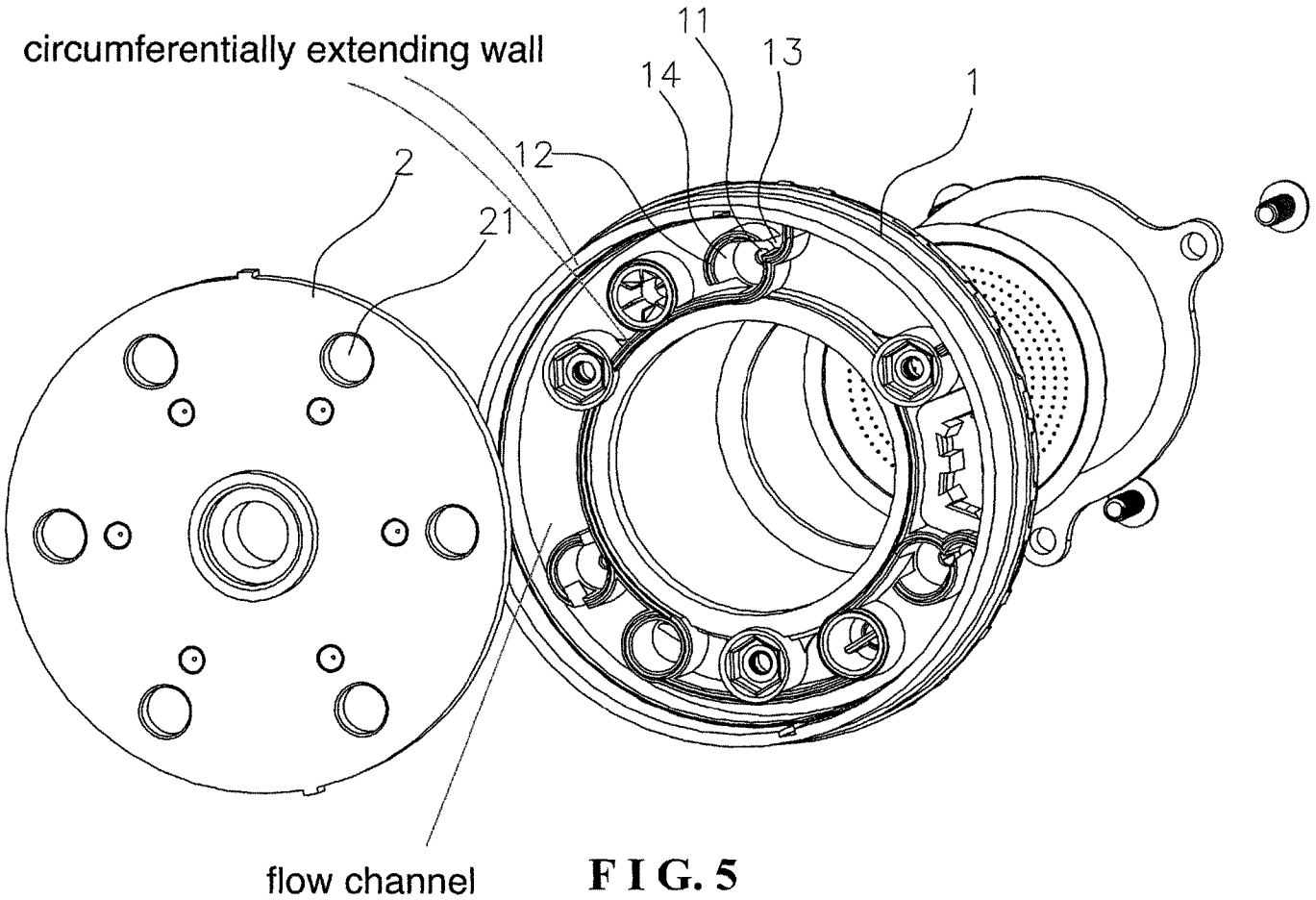
FIG. 5 is an exploded view showing the surface cover and a water distribution member according to the preferred embodiment of the present invention.
Figure 6:
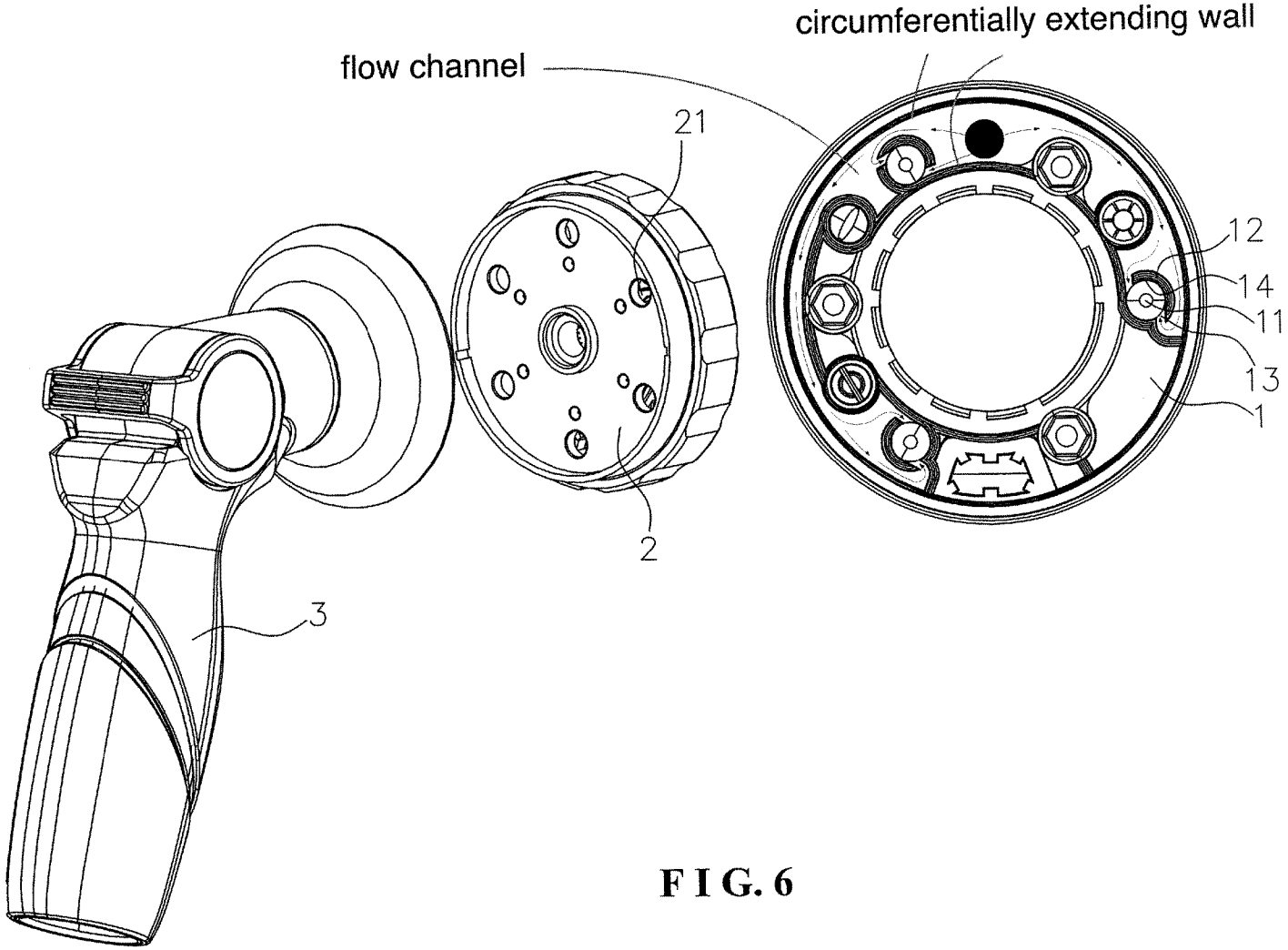
FIG. 6 is an exploded view showing the surface cover of the present invention applied to a water spray gun.

As shown in FIG. 4 to FIG. 6 the present invention disclosures a spray structure of a water spray gun. The spray structure is formed on a surface cover 1. The surface cover 1 is formed with a plurality of spray orifices 11. The inner side of the surface cover 1 is formed with annular flanges 12 each corresponding to the edge of each spray orifice 11. Each flange 12 is formed with a tangential opening 13. Preferably, each flange 12 is formed with two symmetrical tangential openings 13 tangent to an inner wall 14 of the flange 12.

When in use, water flows from the water inlet of a gun body 3 to the gun body 3, and then flows to the surface cover 1 through water distribution holes 21 of a water distribution member 2. Through the tangential opening 13 of the flange 12 at the inner side of each spray orifice 11, the water is rotated and then sprayed out through each spray orifice 11.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A spray structure of a water spray gun, formed on a surface cover, the surface cover being formed with a plurality of spray orifices, an inner side of the surface cover being formed with annular flanges each corresponding to an edge of each spray orifice, each annular flange being formed with a tangential opening defining a water passage extending in a direction tangential to an inner circumference of an inner wall of the annular flange, wherein the surface cover comprises two circumferentially extending walls that are spaced from each other in a radial direction to define therebetween a circumferential water flow channel that has a bottom above which a space is delimited between the two walls for water to flow therethrough, the plurality of spray orifices being formed in the bottom of the flow channel, the annular flanges being raised from the bottom of the flow channel and extending into the space, such that water is guided to flow in the space circumferentially along the flow channel, in a manner of being substantially parallel to the bottom of the flow channel, to reach and pass through the water passage formed in each of the annular flanges toward the spray orifice corresponding thereto.

2. The spray structure of a water spray gun as claimed in claim 1, wherein each annular flange is formed with two symmetrical tangential openings each defining a water passage extending in a direction tangent to the inner circumference of the inner wall thereof.

* * * * *